US010527275B2

(12) United States Patent
Bertocci et al.

(10) Patent No.: US 10,527,275 B2
(45) Date of Patent: Jan. 7, 2020

(54) LAMP FOR LARGE, INDOOR AND OUTDOOR ENVIRONMENTS

(71) Applicant: V.A.P. Stampi di Viviano Bertocci, Pieve a Nievole PT (IT)

(72) Inventors: Francesco Bertocci, Pieve a Nievole PT (IT); Marco Tani, Poggibonsi SI (IT)

(73) Assignee: V.A.P. Stampi di Ciciano Bertocci, Pieve a Nievole PT (IT)

( * ) Notice: Subject to any disclaimer, the term of this patent is extended or adjusted under 35 U.S.C. 154(b) by 271 days.

(21) Appl. No.: 15/475,598

(22) Filed: Mar. 31, 2017

(65) Prior Publication Data

US 2017/0284653 A1 Oct. 5, 2017

(30) Foreign Application Priority Data

Mar. 31, 2016 (IT) ..... 202016000033052
Jan. 20, 2017 (EP) ..... 17152494

(51) Int. Cl.

| | |
|---|---|
| ***F21V 29/89*** | (2015.01) |
| ***F21V 31/00*** | (2006.01) |
| ***F21V 29/76*** | (2015.01) |
| ***F21V 5/04*** | (2006.01) |
| ***F21W 131/10*** | (2006.01) |
| ***F21Y 115/10*** | (2016.01) |
| ***F21W 131/40*** | (2006.01) |

(52) U.S. Cl.
CPC ..... *F21V 29/89* (2015.01); *F21V 5/04* (2013.01); *F21V 29/763* (2015.01); *F21V 31/005* (2013.01); *F21W 2131/10* (2013.01); *F21W 2131/40* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2004/0178727 | A1* | 9/2004 | Song | H05B 33/04 313/512 |
| 2013/0271983 | A1* | 10/2013 | Leshniak | F21V 31/005 362/235 |
| 2014/0268820 | A1* | 9/2014 | Boyer | F21V 21/14 362/362 |
| 2016/0209023 | A1* | 7/2016 | Tseng | F21V 31/005 |

* cited by examiner

*Primary Examiner* — Anh T Mai
*Assistant Examiner* — Zachary J Snyder
(74) *Attorney, Agent, or Firm* — Nancy J. Flint, Attorney at Law, P.A.; Nancy J. Flint, Esq.

(57) ABSTRACT

A lamp for lighting large, indoor and outdoor environments, comprising a LED light source supported by a LED-holder base interposed between a heat sink and a focusing lens. Said base features such configuration and characteristics as to provide, together with two retaining rings and a deformable core hitch, for a high degree of protection against penetration of solid bodies and liquids and for a high thermal dissipation towards the external environment.

15 Claims, 5 Drawing Sheets

LAMP FOR LARGE, INDOOR AND OUTDOOR ENVIRONMENTS

TECHNICAL FIELD

The present invention belongs to the sector of the LED lighting apparatuses conceived for lighting large environments from the top by using high power LEDs, both indoor, for instance in industrial sheds, and outdoor. More specifically, the invention concerns a lamp wherein the LED light source faces downwards, in the direction of the surface to be lighted, and provided with a focusing lens.

PRESENT STATUS OF THE ART

In the reference technical field and in the present text, by LED, an acronym for Light Emitting Diode, we mean any light sources comprising one or several light emitting diodes, however connected to each other, for instance in parallel.

High power LED lighting apparatuses usually comprise a base which supports a LED, a heat sink which disposes of the energy transformed into heat, both by the light emitting diodes and by the electronic components, anchoring means to support the lamp, and electrical power cables.

Since LED emission is strongly directional, i.e. the solid angle subtended by the light beam is extremely narrow, there are two different approaches to distribute it. In some apparatuses, the LED faces downwards and the beam goes through a focusing lens; alternatively, the LED can face an upper reflector, on which light is reflected. An example of such second approach is illustrated in patent application MI2010A002154.

Often lamps for large environments comprise further elements, downstream of the LED, which further improve the distribution of the light beam, such as, for example, a shield, be it transparent or not, or a lens, a frame, or a light fixture.

Usually LED apparatuses incorporate a power supply unit which transforms the alternating current from the mains into a low voltage DC current, whereby the installation of a dedicated electrical power line is not required.

Shields are usually adopted for protection against the introduction of solid bodies and are also taken advantage of to make the light beam uniform, and sometimes co-operate with retaining rings interposed between the shields themselves and the external structure of the lamp. In the above-mentioned patent application MI2010A002154 use is made of a transparent shield only, whereas in patent application VE2008A000065 a retaining ring, or O-ring, is interposed between a lens and the external structure.

The solution illustrated in VE2008A000065 offers a good degree of insulation in the lower part only of the lamp, whereas it features two major drawbacks basically due to the extension of the protected volume. First of all, since the ring is located close to the outer case, water and dust tightness shall be provided along a wide surface. Secondly, insulation limits the thermal dissipation of all elements located inside the protected volume.

Furthermore, a protection shall be provided from external agents also for the head of the lamp, which usually includes a hole for making electrical cables pass through. This protection is usually provided by specifically designed compression glands. It is known that compression glands make the assembling operations more complicate and are subject to ageing.

Therefore, a need is felt for a lamp for large environments that provides heat dissipation and simultaneously also offers a high degree of protection from dusts and liquids, besides featuring optimum lighting characteristics.

OBJECTS AND SUMMARY OF THE INVENTION

An object of the present invention is to provide a LED lamp for large environments featuring a high degree of protection from solid particles and from liquids and simultaneously offering an effective heat exchange with the external world, so as to reduce the external operating temperatures and to preserve the elements that make it up over time.

Another object of the invention described in the present patent application is to improve the focusing of the light beam obtained through the use of lenses of a known type, even made from silicone and, in general, to offer a well uniform and homogeneous light beam.

These objects and others that will be apparent after reading the present application are achieved thanks to a special structure of the lamp and to an innovative configuration of the LED-holder base which, in the preferred embodiment described below, comprises an aluminum or an aluminum-based metal alloy. The innovative configuration makes it possible to limit the volume protected from external agents and to provide a high heat exchange, especially towards the heat sink. In a preferred embodiment, the base, made from aluminum or aluminum-based metal alloy, features an extremely small thickness, namely approximately 15 millimeters. Having a small thickness fosters heat dissipation towards the heat sink.

The lamp according to the present patent application is a direct radiation one, i.e. without any reflector above the LED, hence with the light source facing the area to be lighted underneath. The LED is accommodated inside a seat cut in said LED-holder base which is preferably a disc-shaped one. Under the base a focusing lamp distributes the light stream and limits dazzling whereas, on the upper side, the base is integrally connected to a heat sink. The LED-holder base is usually connected to the LED, to the heat sink, and to the lens by way of connection means of a known type.

Advantageously both the upper surface and the lower surface of the LED-holder base include a seat to receive retaining rings, the latter interfacing to the heat sink and to the focusing lens respectively. Said retaining rings delimit the volume protected from external agents; however electrical cables pass through such volume to supply power to the LED. Tightness is then also provided above by a deformable core hitch which, in a preferred embodiment, is made from rubber, preferably from EPDM, which is the English acronym for Ethylene-Propylene Diene Monomer.

Thanks to the just described measures the protected volume, which receives the LED, is extremely reduced and only affects the central part of the base, so as not to jeopardize heat dissipation from the ends of the base and from the remaining elements of the lamp.

In order to prevent the electrical cables that cross the central zone of the disc from overheating, the feed-throughs that receive them are advantageously coated by an insulating material which, in a preferred embodiment, is a film made from a high-performance plastic material, such as polyimide.

Thanks to the use of a LED light source and to the special arrangements described in the present patent application, the subject lamp offers a protection degree IP 67 and does not require any special maintenance operations during its normal life time.

DETAILED DESCRIPTION OF AN EMBODIMENT OF THE INVENTION

Figure 1:
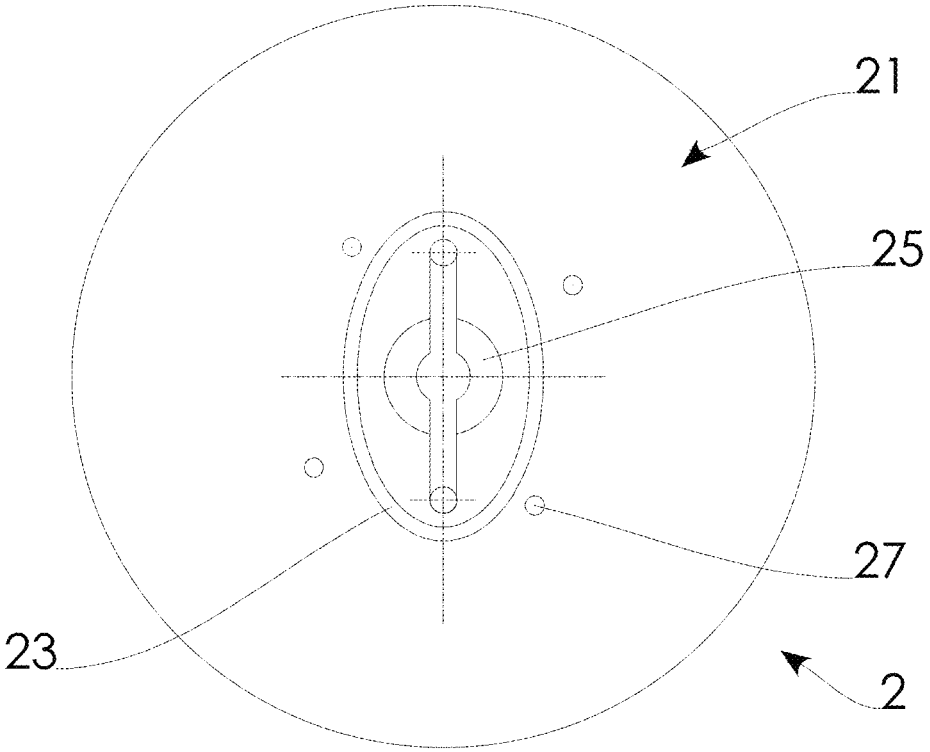
FIG. 1 shows a view of the LED-holder base (2) including, in particular, its upper surface (21), a seat for a core hitch (25), a seat for an upper retaining ring (23), and a through hole (27) for securing the base to a heat sink.
Figure 2:
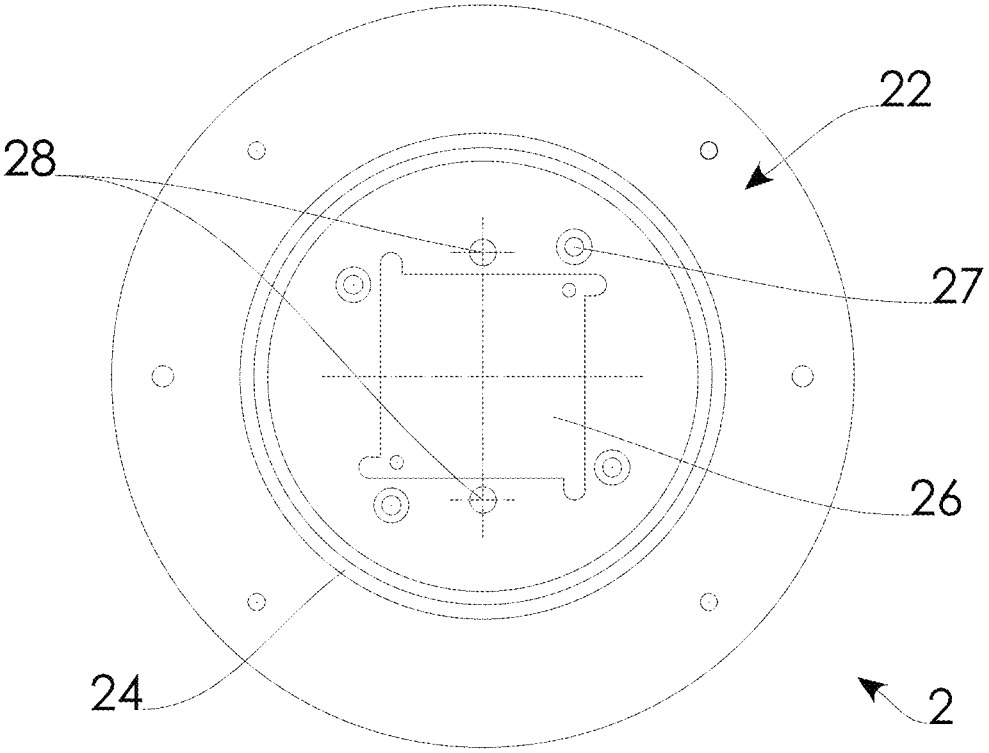
FIG. 2 is a bottom view of the base (2) which highlights the lower surface (22), a seat (26) for a LED, a seat (24) for a lower retaining ring, and holes (28) for LED power cables. Close to the seat (26) of the LED a number of through holes (27) are visible for securing the base (2) to a heat sink. In the embodiment illustrated in the figures, such holes put the zone external to the upper retaining ring in communication to the inside of the lower retaining ring; the holes are treated with a sealant before receiving the screws in order to impart tightness to the holes. For explanatory purposes only, liquid sealants are used which impart water tightness to the threaded fittings. In this embodiment, the arrangement of the holes is determined by the configuration of the heat sink, which does not allow to realize through holes (27) inside the seat (23) of the upper retaining ring (6).
Figure 3:
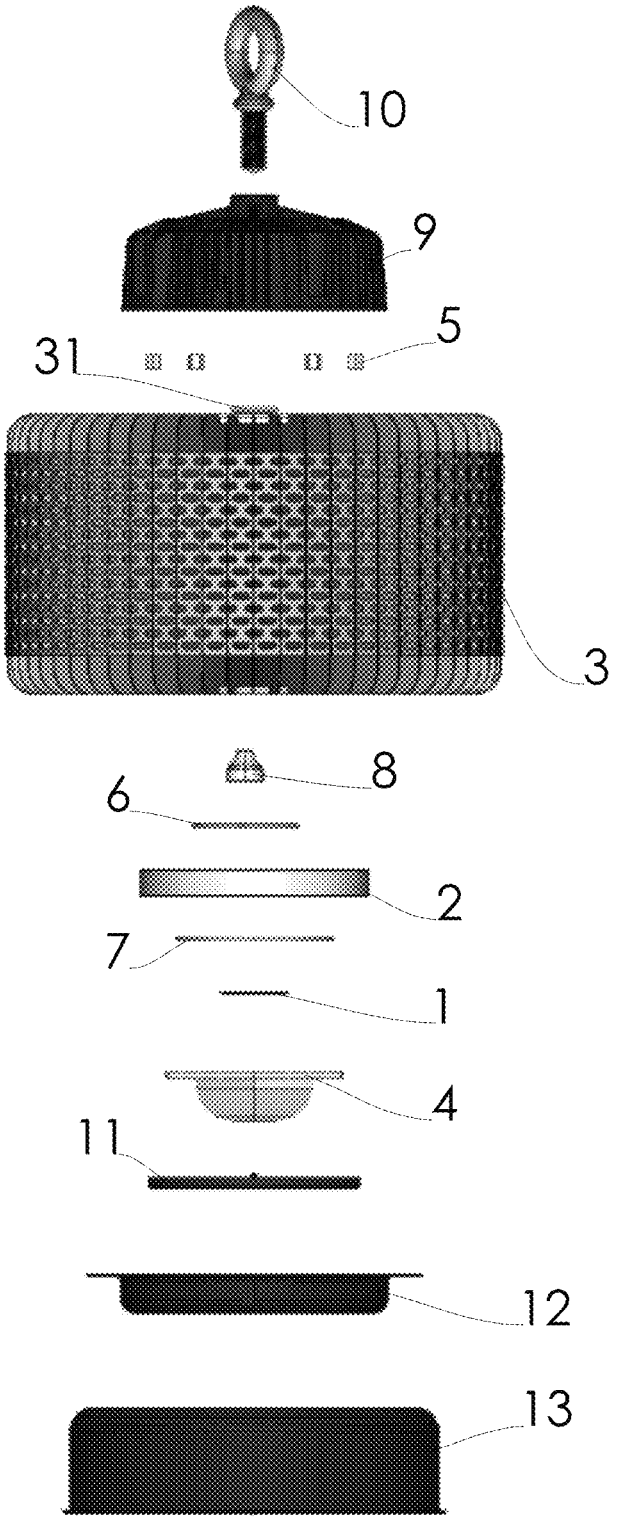
FIG. 3 shows an exploded view of the lamp, wherein it is possible to identify the individual components, but the electrical cables used to supply power to the COB LED (1) and the power supply unit (9). The lamp includes anchoring means (10) on the upper part suitable for engaging other suspension devices; in the example here shown, use is made of an eyebolt screwed in the outer case of the power supply unit (9). Between the latter and the heat sink (3) there are interposed metal spacers (5) which foster air flow on the surface of the heat sink. For the same purpose, projecting fins (31) are advantageously obtained by bending some portions of the upper surface of the heat sink (3). Under the heat sink there is visible the LED-holder base (2) with the retaining rings (6, 7), a core hitch (8) and a focusing lens (4). A ring (11), a frame (12), and a light fixture (13) are visible in the lower side. Downstream of the assembly, the frame (12) abuts the ring (11) which thus partially covers the focusing lens (4) and its respective screws for connecting to the base (2). Conversely, the light fixture makes it possible to drastically reduce or even zero the light stream in correspondence with angles greater than a determined value; in a preferred embodiment, the light fixture limits the emission beyond 126 sexagesimal degrees with respect to the vertical axis.
Figure 4:
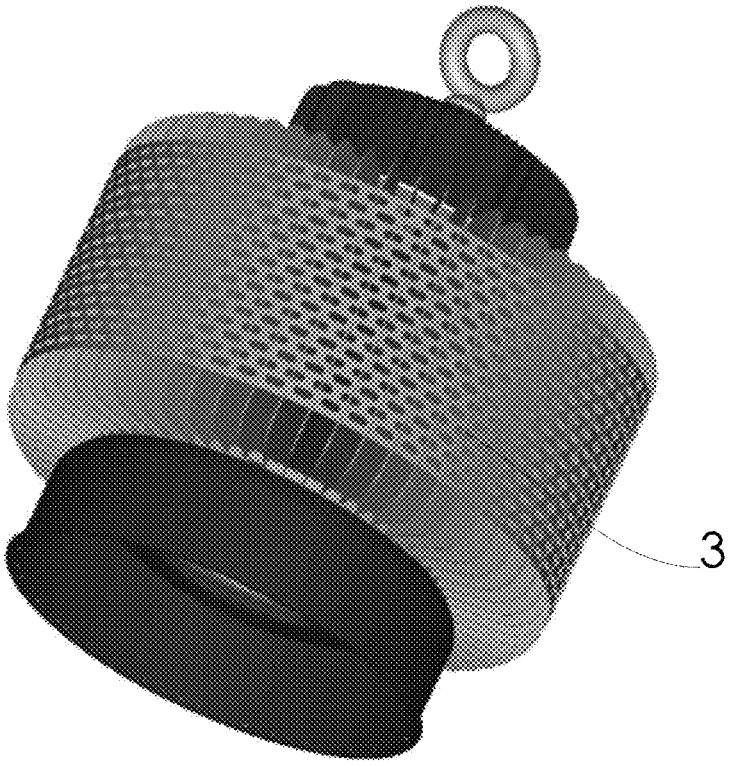
FIG. 4 shows an axonometric side view of the lamp and makes it possible to look at the structure of the heat sink (3).
Figure 5:
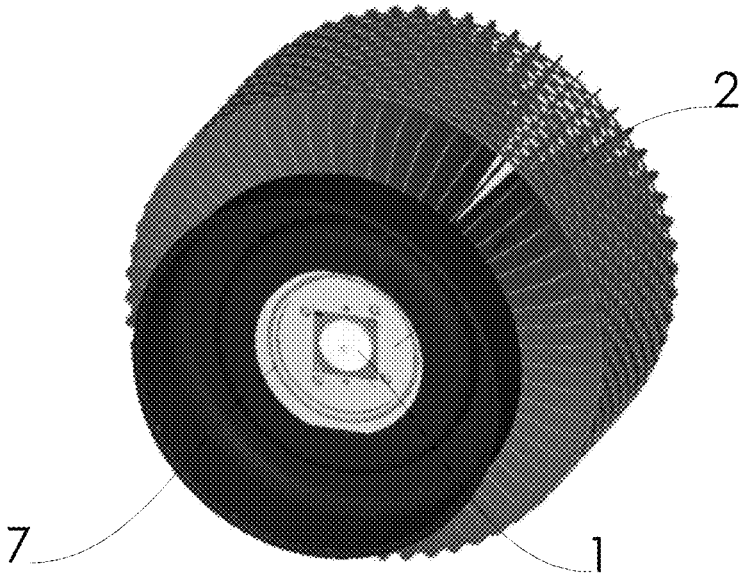
FIG. 5 shows an axonometric bottom view of the lamp and allows to look at the LED (1) mounted onto the base (2), as well as at the retaining ring (7), under the focusing lens.
Figure 6:
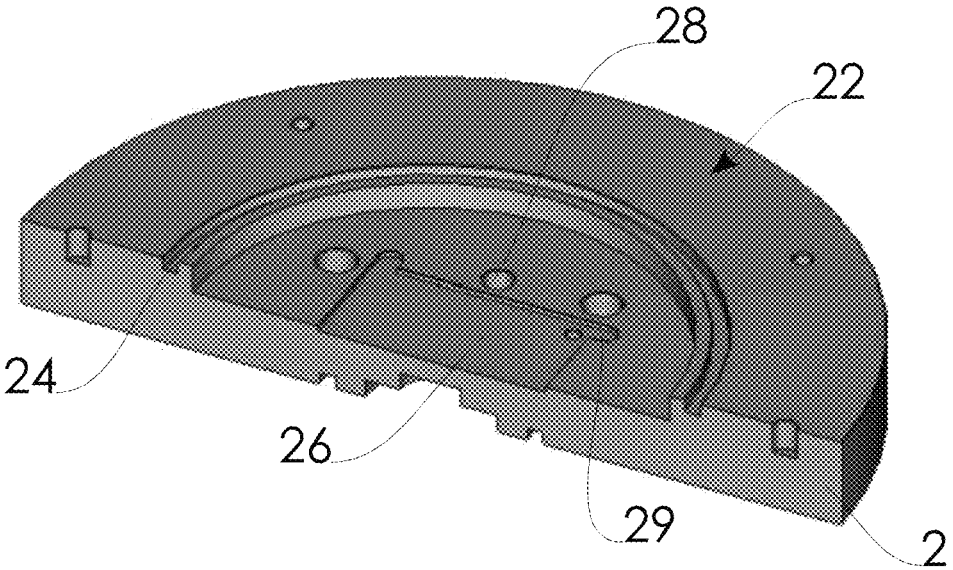
FIG. 6 is an axonometric cross-sectional view of the base (2) and shows the main machinings made on the lower surface (22) side; in particular, the seat (26) for the LED, the seat (24) for the lower retaining ring, and the hole (28) for the electrical cable.
Figure 7:
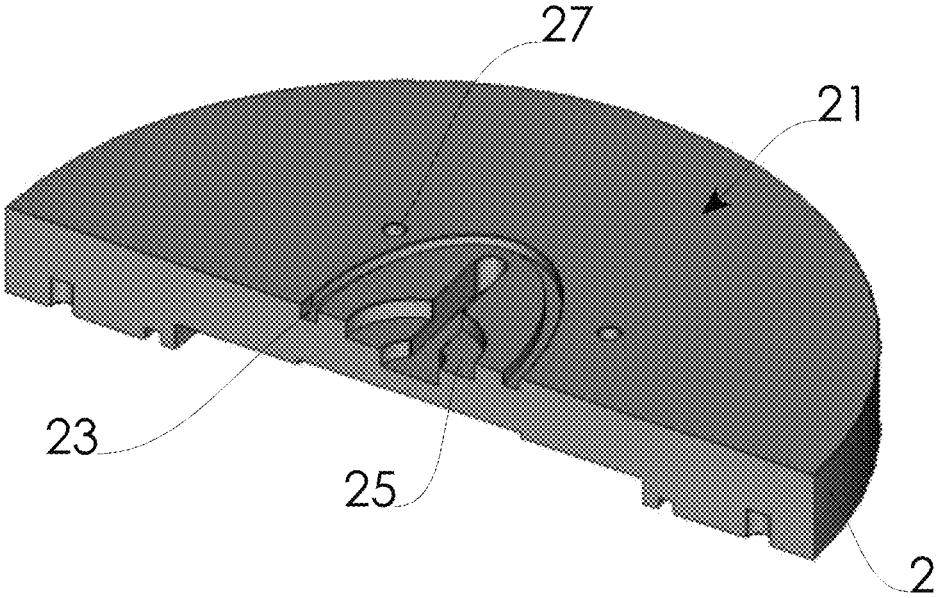
FIG. 7 shows an axonometric cross-sectional of the base (2) and allows to look at the machinings made on the upper surface (21) side; in particular, the seat (25) for the core hitch, the seat (23) for the upper retaining ring, and the through hole (27) for the screws used for securing to the heat sink.
Figure 8:
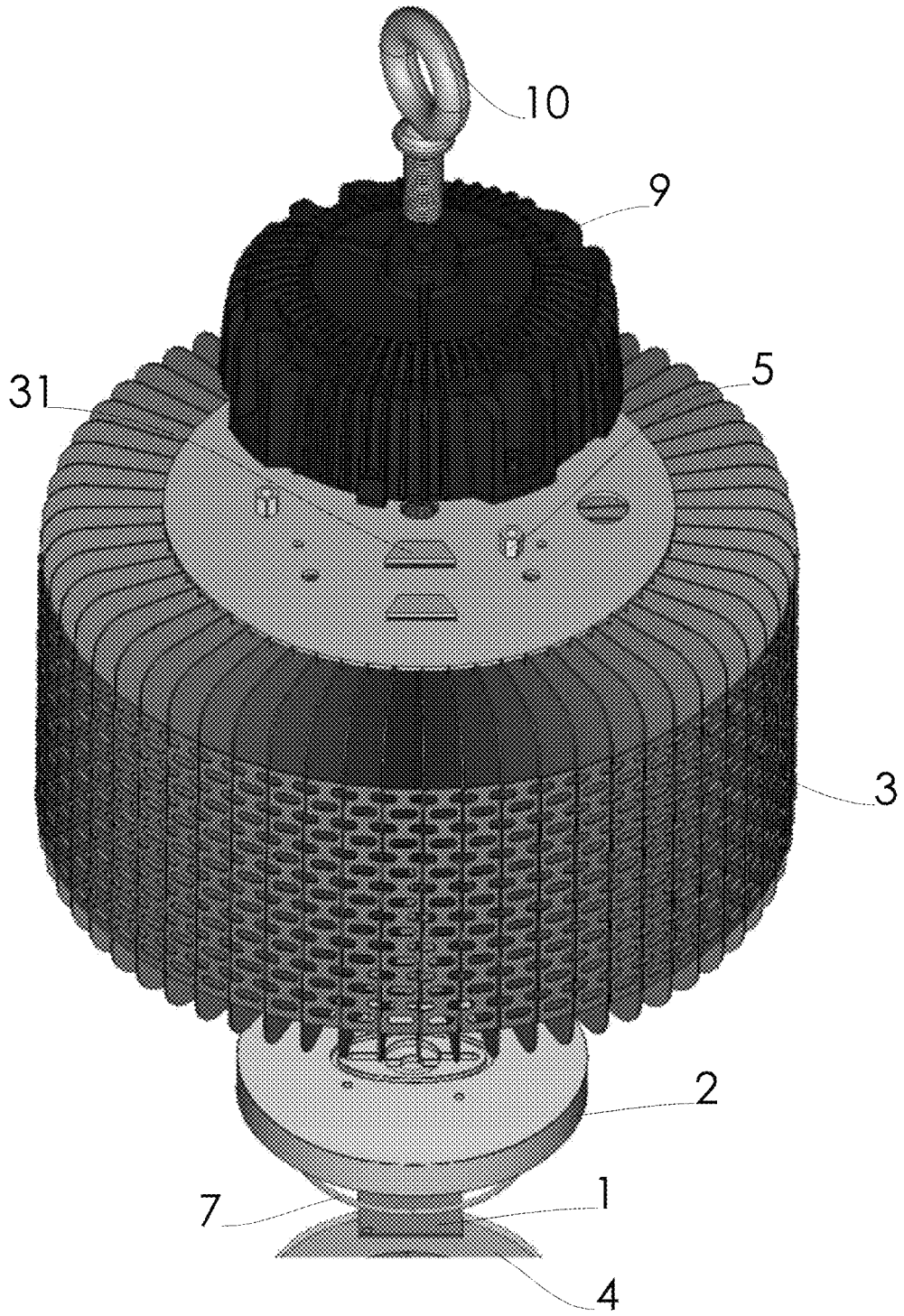
FIG. 8 shows a partial enlargement of an axonometric side view of the lamp wherein the following component parts are visible: a supporting eyebolt (10), a power supply unit (9), metal spacers (5), projecting fins (31) of the heat sink (3), the LED-holder (1) base (2), the lower retaining ring (7), and a part of the focusing lens (4).

In a preferred embodiment of the LED lamp for large environments according to the present patent application, the light source is a COB LED, where COB stands for Chip-On-Board, accommodated in a seat (26) cut in the lower surface of a disc-shaped base (2), preferably made from aluminum, and usually secured by way of screws.

On the upper side, said base (2) is integrally coupled, generally by way of threaded connections, to a heat sink (3) having a number of fins for fostering heat dissipation. The heat sink (3) is usually a high-efficiency one, so as to foster the preservation of low operating temperatures on the outer surface of the lamp.

In the preferred embodiment here described, the lamp is equipped with a LED power supply unit, interposed between upper anchoring means (10) and said heat sink. In a particularly practical and easy to install embodiment, said anchoring means are an eyebolt.

Advantageously the connection between the case of the power supply unit and the heat sink supports the interposition of some metal spacers (5).

Under said base there is conversely present a focusing lens (4), made from silicone, which improves light distribution and prevents dazzling.

Advantageously the lamp according to the present patent application comprises two retaining rings (6, 7), accommodated in appropriate seats (23, 24) cut in said base (2). After assembling the base (2) on the heat sink (3), the upper retaining ring (6) is interposed between the upper surface (21) of said base (2) and the lower surface of the heat sink (3). Likewise, after positioning the focusing lens (4) onto the base (2), the lower retaining ring (7) gets pressed between the upper edge of said focusing lens (4) and the lower surface (22) of said base (2).

Preferably are the retaining rings made from silicone, so as to increase their reliability even in the presence of strong thermal stresses.

The retaining rings prevent particles and liquids from penetrating in the radial direction of the disc-shaped base (2).

Since an opening is present on the upper side for making the LED power supply cables feed through, it is necessary to provide an upper tightness by way of a core hitch (8) made from a deformable material, for instance rubber, received in a respective seat (25) cut in the upper surface (21) of said base (2). According to a practical embodiment, the core hitch (8) is made from EPDM. After mounting the base (2) onto the heat sink, the core hitch (8) gets squashed and provides the desired protection.

In order to limit the volume of the base protected from penetration of particles and liquids, the retaining rings are not located on the outer perimeter of the disc, but rather as much internally as possible.

In particular, the lower seat (24) for the retaining ring (7) circumscribes and perimetrically delimits the area occupied by said at least one LED light source (1).

Likewise, the upper seat (23) for the retaining ring (6) circumscribes and perimetrically delimits the seat (25) of the core hitch (8).

In the preferred embodiment here described, the feed-throughs that receive the power cables depart from the seat (25) of the core hitch (8) and reach the two connection points located at the two opposite sides of the COB LED. In the embodiment illustrated in the attached drawings, said feed-throughs comprise two holes (28) located externally to the two opposite sides of the LED seat (26).

According to an improved embodiment, said feed throughs are coated by an insulating material. In a practical embodiment, the material used is a high-resistance plastic film, called polyimide and marketed under the name of Kapton.

In the preferred embodiment here described, the lower side of the lamp is completed with a frame (12) and a light fixture (13), both made from anodized aluminum, both for aesthetical reasons and for improving heat dissipation, in that they are in contact with the lower surface of the base (2) or, possibly, with the heat sink (3).

In a particularly efficient embodiment the disc-shaped aluminum base (2) features a thickness in the range from 12 to 20 millimeters, preferably equal to approximately 15 millimeters. Such thickness ensures a reduced thermal inertia while retaining a good workpiece machinability.

According to a particularly practical solution, on the lower surface (22) of the base (2) there is present at least one slot (29) adjacent to the side edge of the seat (26). Such one or several slots make it possible a simple and quick removal of the LED, for instance while performing maintenance or replacement operations. In the embodiment illustrated in the attached drawings, there are present four slots in proximity to the edges of the LED seat (26).

The invention claimed is:

1. A LED lamp for large environments, comprising a LED-holder base, on the lower surface of which there is present at least one seat for at least one LED light source, said base being integrally connected, on the upper side, to a heat sink that is distinct and separate from the base presenting a plurality of projecting fins extending from an upper surface of the heat sink, and, on the lower side, to a focusing lens that distributes the light stream from the LED light source, characterized in that the LED lamp comprises an upper retaining ring and a lower retaining ring, accommodated in an upper seat and a lower seat, respectively, which upper seat and lower seat are cut on the upper surface and on the lower surface respectively of said base, so as to be interposed between said base and said heat sink, and said base and said focusing lens respectively, wherein the upper side of said base includes a core hitch seat that accommodates an at least partially deformable core hitch, internally to which electrical cables pass through to supply power to said LED light source, wherein further said lower seat for the lower retaining ring circumscribes and perimetrically delimits an area occupied by said at least one LED light source.

2. The LED Lamp according to claim 1, characterized in that said upper seat for the upper retaining ring circumscribes and perimetrically delimits the seat of the core hitch.

3. The LED Lamp according to claim 2, characterized in that it comprises a power supply unit for supplying power to at least one LED light source located above said heat sink and integrally connected thereto; said power supply unit being in turn connected to anchoring means of the LED lamp.

4. The LED Lamp according to claim 3, characterized in that between said power supply unit and said heat sink there are interposed one or several metal spacers.

5. The LED Lamp according to claim 4, characterized in that said base is made from aluminum-based metal alloy.

6. The LED Lamp according to claim 3, characterized in that said base is made from aluminum-based metal alloy.

7. The LED lamp according to claim 1, characterized in that said upper and lower retaining rings are made from silicone.

8. The LED lamp according to claim 1, characterized in that it comprises at least one slot adjacent to the side edge of one of said at least one seat for at least one LED light source.

9. The LED lamp according to claim 1, characterized in that said LED light source is a COB (Chip-On-Board) LED.

10. The LED lamp according to claim 1, characterized in that said base is disc-shaped.

11. The LED lamp according to claim 1, characterized in that said base features a thickness of approximately 15 millimeters.

12. The LED lamp according to claim 1, characterized in that the power for said LED light source is supplied by at least one cable which crosses said base in a feed through which is coated by an insulating material.

13. The LED lamp according to claim 12, characterized in that said insulating material is a polyimide film.

14. The LED lamp according to claim 1, characterized in that said upper seat for the upper retaining ring circumscribes and perimetrically delimits the seat of the core hitch.

15. The LED lamp according to claim 14, characterized in that said core hitch is made from EPDM (Ethylene-Propylene Diene Monomer).

* * * * *